US010288316B1

(12) United States Patent
Currey et al.

(10) Patent No.: US 10,288,316 B1
(45) Date of Patent: May 14, 2019

(54) DIP TUBE

(71) Applicant: Mercury Plastics LLC, Middlefield, OH (US)

(72) Inventors: Donald Currey, Chagrin Falls, OH (US); Scott R. Gardner, Chagrin Falls, OH (US)

(73) Assignee: Mercury Plastics LLC, Middleford, OH (US)

( * ) Notice: Subject to any disclaimer, the term of this patent is extended or adjusted under 35 U.S.C. 154(b) by 922 days.

(21) Appl. No.: 14/446,074

(22) Filed: Jul. 29, 2014

Related U.S. Application Data

(60) Provisional application No. 61/915,782, filed on Dec. 13, 2013, provisional application No. 61/859,575, filed on Jul. 29, 2013.

(51) Int. Cl.
*F24H 9/00* (2006.01)
*F24H 9/14* (2006.01)

(52) U.S. Cl.
CPC ..... *F24H 9/0047* (2013.01); *F24H 9/14* (2013.01)

(58) Field of Classification Search
CPC ..... F24H 1/205; F24H 9/124; F24H 9/0047; F24H 9/14
USPC ..... 392/457; 122/18.2, 18.3, 63, 451 R, 122/14.31, 19.1
See application file for complete search history.

(56) References Cited

U.S. PATENT DOCUMENTS 2,123,809 A 7/1938 Seitz
2,602,465 A 7/1952 Goehring
2,764,427 A 9/1956 Andrus
3,082,024 A 3/1963 Boylan
3,726,475 A * 4/1973 Eising ..... F24H 9/124 122/19.1
3,776,456 A * 12/1973 Eising ..... F24H 9/124 122/19.1
4,964,394 A * 10/1990 Threatt ..... F24H 9/124 122/14.31
5,277,171 A 1/1994 Lannes
5,988,117 A 11/1999 Lannes
6,138,614 A 10/2000 Shropshire et al.
6,269,780 B1 8/2001 Hughes
6,745,723 B1 6/2004 Hicks et al.
7,093,565 B2 8/2006 Robison
7,203,418 B1 * 4/2007 York ..... F24H 9/124 392/441
7,766,043 B2 8/2010 Thomas et al.
7,819,137 B2 10/2010 Nelson et al.
7,850,898 B1 12/2010 Rowley et al.
7,861,678 B2 1/2011 McClellan
7,891,382 B2 2/2011 Rushlander et al.
7,927,534 B1 4/2011 Seman, Sr. et al.
(Continued)

*Primary Examiner* — Ibrahime A Abraham
*Assistant Examiner* — Biniam B Asmelash
(74) *Attorney, Agent, or Firm* — Hahn Loeser & Parks LLP

(57) ABSTRACT

A dip tube for use with a water heater having a pipe nipple, the dip tube including an upper end and a tubular body, where the upper end is located above the tubular body. The upper end has an outer wall, a top portion and bottom portion, and further includes a flange located at the top portion. The flange extends outwardly from the outer wall to retain the dip tube at the pipe nipple. The upper end also includes a reinforced connecting portion located at the bottom portion for connecting the upper end to the tubular body, where a portion of the tubular body is located within the reinforced connecting portion.

15 Claims, 16 Drawing Sheets

(56) References Cited

U.S. PATENT DOCUMENTS

| | | | | |
|---|---|---|---|---|
| 8,220,126 | B1 | 7/2012 | Yunk et al. | |
| 8,277,714 | B1 | 10/2012 | Blue et al. | |
| 8,329,088 | B1 | 12/2012 | Rowley et al. | |
| 8,337,738 | B1 | 12/2012 | Seman, Sr. et al. | |
| 8,343,407 | B1 | 1/2013 | Seman, Sr. et al. | |
| 8,365,770 | B2 | 2/2013 | Thomas et al. | |
| 8,431,067 | B2 | 4/2013 | Rowley et al. | |
| 8,454,874 | B2 | 6/2013 | Rushlander et al. | |
| 8,646,476 | B2 | 2/2014 | Thomas et al. | |
| 8,789,854 | B2 | 7/2014 | Christian, Jr. et al. | |
| 8,865,051 | B1 * | 10/2014 | Rowley | B29C 71/04 264/248 |
| 2005/0139171 | A1 * | 6/2005 | Robison | F24H 9/124 122/14.31 |
| 2005/0263190 | A1 | 12/2005 | Hammond et al. | |
| 2011/0247572 | A1 * | 10/2011 | Smith | F24H 1/205 122/19.1 |

* cited by examiner

DIP TUBE

This application claims the benefit of U.S. Provisional Patent Application No. 61/859,575, filed Jul. 29, 2013 and U.S. Provisional Patent Application No. 61/915,782, filed Dec. 13, 2013.

BACKGROUND AND SUMMARY OF THE INVENTION

It is known to provide a dip tube in a water heater to supply cold water to the tank. The cold water is injected at the bottom of the tank through the dip tube. The cold water is then heated where it rises in the water heater and is drawn off by a hot water discharge pipe. A pipe nipple connects to the water heater, the water heater being made from steel, and allows plumbing for the cold water inlet to be connected to the water heater. The pipe nipple is threaded on both ends and is typically made of brass, galvanized steel, or galvanized steel with a dielectric insert.

Although the exterior of galvanized nipples are dielectrically compatible with the steel water heater, the interior of the galvanized nipple is not. With the interior unprotected, the galvanized nipple corrodes, clogs, rusts and eventually leaks. Brass nipples, on the other hand, internally will not corrode like galvanized nipples, but the introduction of brass to the steel water heater is not a dielectrically correct connection. Left unprotected, the area of the steel water heater below the brass nipple corrodes. Therefore, a dielectric connection is desired because it prevents electrolysis with the connecting plumbing and the steel water heater.

To combat the corrosion issue and provide a dielectric connection, water heater manufacturers are now supplying plastic lined galvanized nipples with new water heaters. This plastic liner in the galvanized nipple is also known as the dielectric liner. These plastic lined galvanized nipples are sometimes referred to as dielectric nipples. The dielectric nipples and the brass nipples cost more than the galvanized steel nipples.

As noted above, the pipe nipple is threaded on both ends, where one threaded end connects to the water heater via a coupling and the other threaded end connects to the plumbing. The dip tube is located below the threaded end of the pipe nipple that connects to the water heater. The dip tube typically rests within the coupling but requires a gasket and a dip tube cup to retain the dip tube therein. The dip tube cup is also known as a retaining cup. The dip tube, the dielectric liner, the gasket and the dip tube cup are separate components that must be assembled or disassembled during installation and/or service of the water heater. This results in increased amounts of labor for verification of both the proper assembly and efficient functionality of each separate component. This increased labor results in increased costs for the manufacturer and servicemen which are typically passed on to the consumer. Moreover, improper installation of these separate components can result in leaks, which may form between the dip tube and the pipe nipple. As a result of the above, there is a need to reduce the labor and costs associated with the assembly and repair of a dip tube for a water heater and to provide a leak free dip tube.

It is also known for a dip tube to have a plurality of holes drilled or punched in the side of the dip tube near its bottom to disperse the cold water at the bottom of the water heater. After the holes are drilled or punched, the opening at the bottom of the dip tube is melted to close the bottom by a heat sealing process. The drilling or punching of the holes may not be dimensionally accurate due to the inaccuracy of the tools used for drilling or punching as well as operator error. This dimensional inaccuracy of the holes creates uneven dispersion of the cold water at the bottom of the water heater which increases the mixture of cold water with the hot water in the water heater and increases heat loss. The heat sealing process creates inconsistent results and requires an expensive piece of equipment. The extensive labor involved in drilling or punching the holes and subsequent melting of the bottom of dip tube increases the overall costs associated with the dip tube. Thus, there is also a need to reduce the labor and costs associated with the manufacture of the bottom of the dip tube for dispersing the cold water near the bottom of the water heater.

What is disclosed is a dip tube for use with a water heater having a pipe nipple, the dip tube comprising:

an upper end and a tubular body, the upper end being located above the tubular body;

the upper end having an outer wall, a top portion and bottom portion, the upper end comprising:

- a flange located at the top portion, the flange extending outwardly from the outer wall for retaining the dip tube at the nipple;
- a reinforced connecting portion located at the bottom portion for connecting the upper end to the tubular body, where a portion of the tubular body is located within the reinforced connecting portion.

The reinforced connecting portion maintains the position of the tubular body in the absence of a gasket and a retaining cup. The upper end may be overmolded onto the tubular body or mechanically attached to the tubular body. The dip tube may include a spacer for guiding and locating the upper end during insertion into the pipe nipple. The spacer may include plurality of ribs extending axially along the outer wall of the upper end.

The dip tube may further include a heat trap assembly that is integral with the upper end. The heat trap assembly may include at least one annular groove located on the outer wall of the upper end and having a circumferential slot andat least one heat trap having an outer ring portion, an inner portion, a partial circular slot and a connecting portion connecting the outer ring portion to the inner portion between the partial circular slot. The outer ring portion may located within the at least one annular groove and the inner portion extends through the partial circular slot and is located within the tubular body.

The dip tube may include a lower end connected to the tubular body. The lower end may include a top end, a bottom end, an outer wall, an inner wall and a bottom wall. The lower end may further include a plurality of openings to slow and disperse the flow of water from the tubular body into the water heater and a portion of the tubular body may be within the top end of the lower end.

The lower end may be overmolded onto the tubular body or mechanically attached to the tubular body. The lower end may be generally cylindrical. The outer wall of the lower end may include opposing flattened portions.

The plurality of openings may be maximized to slow and disperse the flow of water from the tubular body into the water heater and the material is minimized between the plurality of openings for the lower end to be structurally sufficient during use within the water heater.

The dip tube may include cylindrical portions located on either side of the flattened portions on the lower end, and the plurality of openings may include circular openings on the flattened portions and D-shaped openings on the cylindrical portions.

The the D-shaped openings may include a first set of openings positioned adjacent a second set of openings, and the straight portions of the D-shaped openings may bee proximal one another and the curved portions of the D-shaped openings may be distal each other.

What is disclosed is a combination of a dip tube and a pipe nipple for use with a water heater, the combination comprising:

a pipe nipple having a top portion, a bottom portion, an upper threaded end at the top portion and a lower threaded end at the bottom portion; and a dip tube comprising:

an upper end and a tubular body, the upper end being located above the tubular body;

the upper end having an outer wall, a top portion and bottom portion, the upper end comprising:

a flange located at the top portion, the flange extending outwardly from the outer wall for retaining the dip tube at the nipple;

a reinforced connecting portion located at the bottom portion for connecting the upper end to the tubular body, where a portion of the tubular body is located within the reinforced portion;

where the flange of dip tube is located on the upper threaded end at the top portion of the pipe nipple.

The combination of the dip tube and pipe nipple may include a coupling for attaching the pipe nipple to the water heater, where the combination is free of a gasket and a retaining cup and where the pipe nipple is free of an integrally attached dielectric liner and a separate heat trap assembly.

The foregoing and other objects, features and advantages of the invention will be apparent from the following more detailed descriptions of particular embodiments of the invention, as illustrated in the accompanying drawings wherein like reference numbers represent like parts of the invention.

DETAILED DESCRIPTION OF PARTICULAR EMBODIMENTS

Various embodiments of the invention described herein provide a leak free dip tube that replaces multiple separate components including a dielectric liner, heat trap assemblies, a gasket and a dip tube cup or retaining cup for a water heater. The leak free dip tube may be a one-piece construction.

Figure 1:
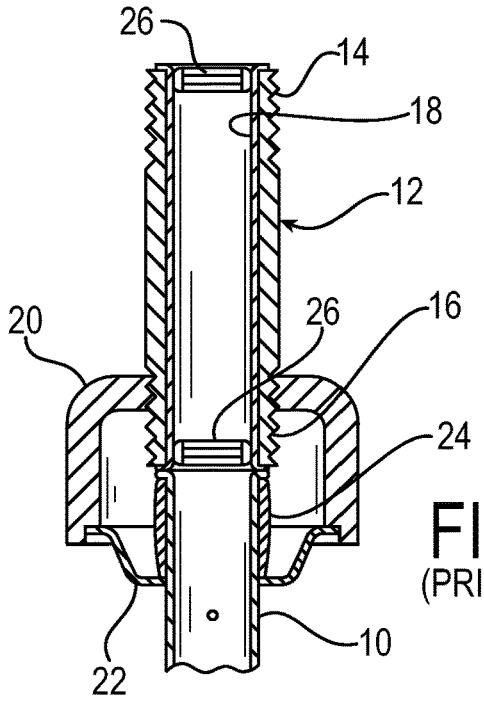
FIG. 1 (PRIOR ART)
FIG. 1 is a cross-sectional view of a dip tube connected to a nipple of a water heater according to the prior art.

As noted above, there are a number of separate components with respect to installation, repair and replacement a dip tube for a water heater. By example, FIG. 1 displays a cross-sectional view of a dip tube 10 connected to a nipple 12 of a water heater according to the prior art. Nipple 12 includes upper threads 14 and lower threads 16 on each end of the nipple 12. A dielectric liner 18 is located on the inner surface of the nipple 12. Upper thread 14 connects to plumbing (not shown) while lower thread 16 connects to a coupling 20 of the water heater. A dip tube cup or retaining cup 22 is located near the bottom of the coupling 20. A gasket 24 is located below the nipple 12 and around an upper portion of the dip tube 10 and rests upon the dip tube cup to retain the dip tube in position. Separate heat trap assemblies 26 are respectively installed within the nipple 12 near the upper threads 14 and the lower threads 16. A leak point exists at the connection of the dip tube 10 and the nipple 12. If either of the gasket 24 or the dip tube cup is installed improperly, the dip tube 10 may not seat properly in the water heater. If not seated properly, a gap is created between the dip tube 10 and the nipple 12 which can leak water. Additionally, if the nipple 12 is not threaded completely into the coupling 20, a gap will exist between the dip tube 10 and the nipple 12 which can also leak water. Any water leaks in this area of the water heater may cause cold water to mix with the hot water at the top of the water heater which reduces the efficiency of the water heater. Also, water leaks may cause corrosion of parts in the water heater not meant to be exposed to water.

Figure 2:
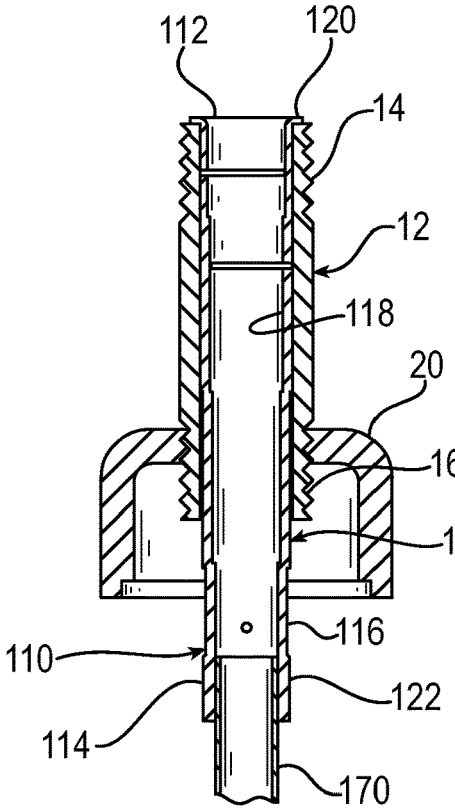
FIG. 2 is cross-sectional view of a dip tube connected to a nipple of a water heater according to an embodiment of the present invention.
Figure 3:
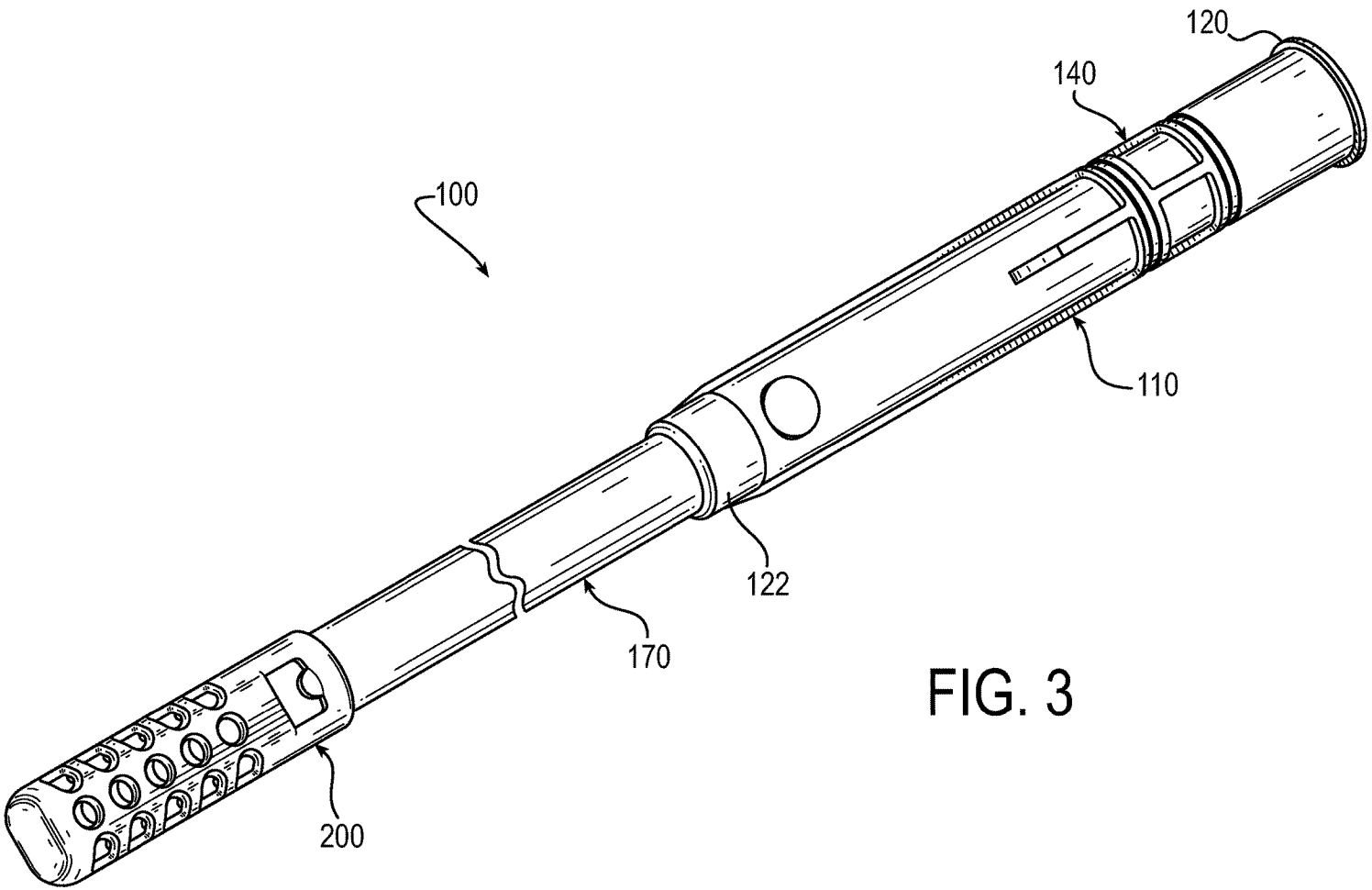
FIG. 3 is a perspective view of a dip tube according to an embodiment of the present invention.
Figure 4:
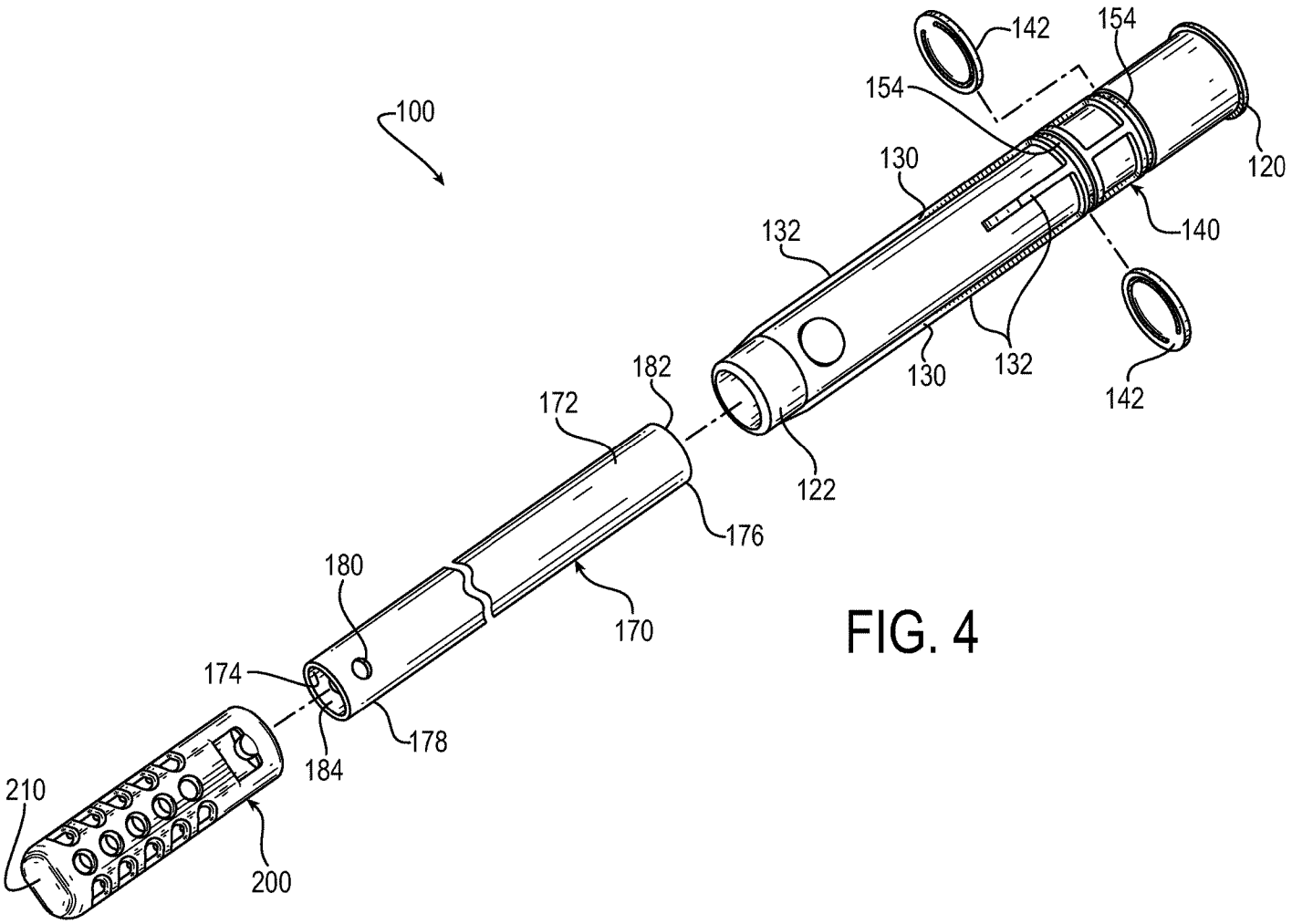
FIG. 4 is an exploded perspective view of the dip tube of FIG. 3.

Referring now to FIG. 2, a dip tube 100 according to an embodiment of the present invention is shown. FIG. 2 displays a cross-sectional view of the dip tube 100 connected to a nipple 12 of a water heater. Nipple 12 includes upper threads 14 and lower threads 16 on each end of the nipple 12. Upper thread 14 connects to plumbing (not shown) while lower thread 16 connects to a coupling 20 of the water heater. The nipple 12 is free of any dielectric liner as will be further discussed herein. Additionally, the dip tube 100 of FIG. 2 is free of a dip tube cup or retaining cup and a gasket.

The dip tube 100 includes an upper end 110 and a tubular body 170. The upper end 110 is located above the tubular body 170 as seen in FIG. 2. The upper end 110 is generally cylindrical so as to be inserted and fit within the nipple 12. The upper end 110 may be any shape that allows it to be inserted into and fit within the nipple 12. The tubular body 170 is also generally cylindrical but may be any shape that allows it to be inserted through the nipple 12.

Figure 8:
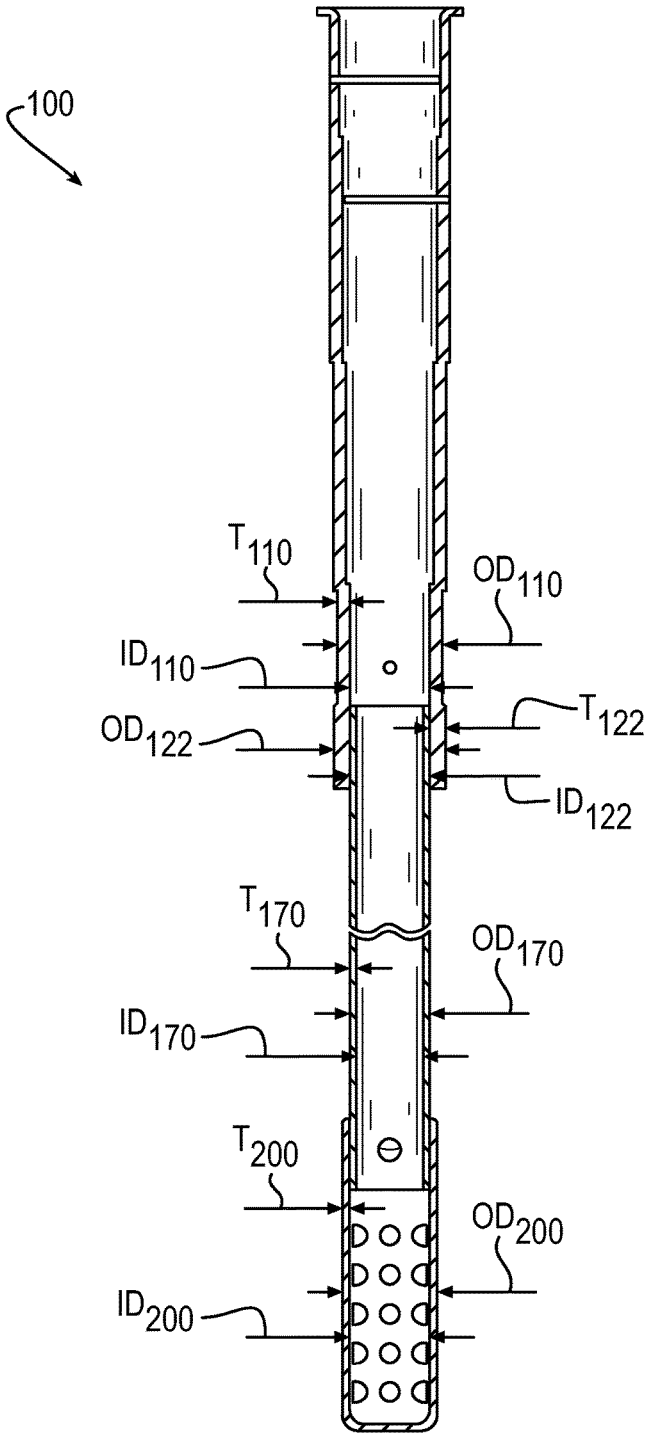
FIG. 8 is a cross sectional view of the dip tube of FIG. 3.

With references to FIGS. 2 and 5A-5C, the upper end 110 has a top portion 112, a bottom portion 114, an outer wall 116 and an inner wall 118. The upper end 110 includes an inner diameter $ID_{110}$ and an outer diameter $OD_{110}$ as seen in FIG. 8. The upper end 110 has a thickness $T_{110}$ measured between the inner wall 118 and the outer wall 116. The upper end 110 includes a flange 120 located near the top portion 112. The flange 120 extends outwardly from the outer wall 116 and around the entire circumference of the upper end 110. In an alternative embodiment, the flange 120 may extend only partially around the circumference of the upper end 110. In other words, the flange 120 may either be a solid radial flange or one with gaps. The flange with gaps may allow for more efficient molding. The flange 120 retains the dip tube 100 in the nipple 12 and prevents the dip tube 100 from falling into the nipple 12 when installed in the water heater. The flange 120 sits upon the top of the nipple 12 as seen in FIG. 2.

The upper end 110 further includes a reinforced connecting portion 122 for connecting the upper end 110 to the tubular body 170. The reinforced connecting portion 122 is located at the bottom portion 114 of the upper end 110. A portion of the tubular body 170 is located within the reinforced connecting portion 122 as seen in FIG. 2. The reinforced connecting portion 122 has a thickness $T_{122}$ measured as the distance between an inner wall 124 and an outer wall 126 of the reinforced connecting portion 122 as shown in FIG. 8. The thickness $T_{122}$ of the reinforced connecting portion is greater than the thickness $T_{ito}$ of the upper end 110. The outer wall 116 of the upper end 110 may taper from the flange 120 to the reinforced connection portion of the upper end 110.

Figure 5A:
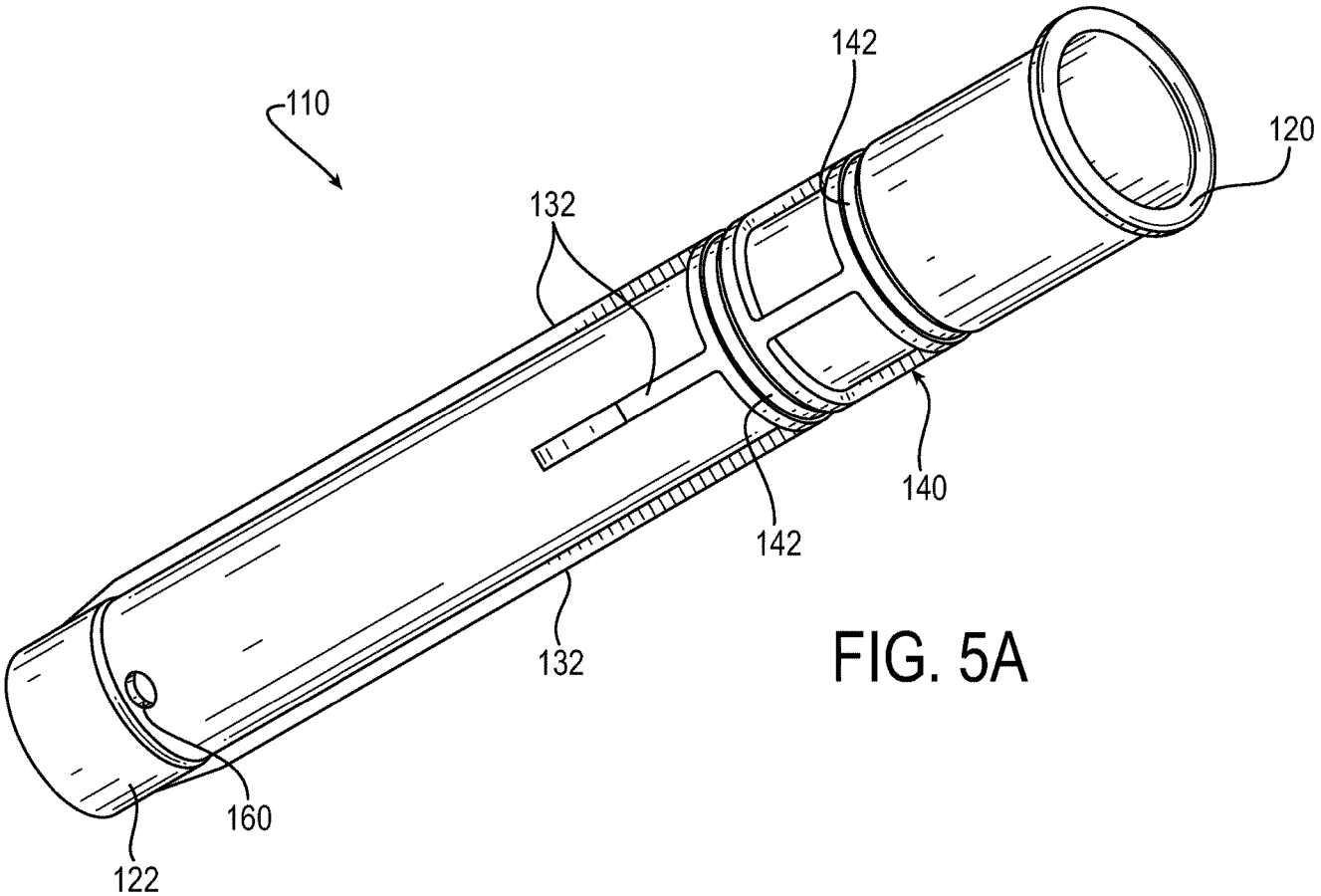
FIG. 5A is a perspective view of an upper end of the dip tube according to an embodiment of the present invention.
Figure 5B:
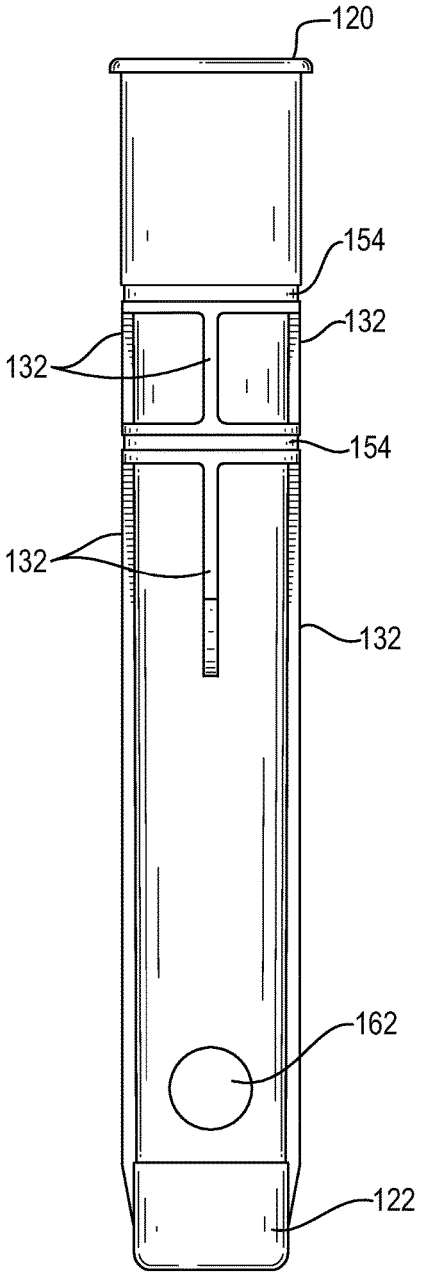
FIG. 5B is a rear view of the upper end of the dip tube of FIG. 5A.
Figure 5C:
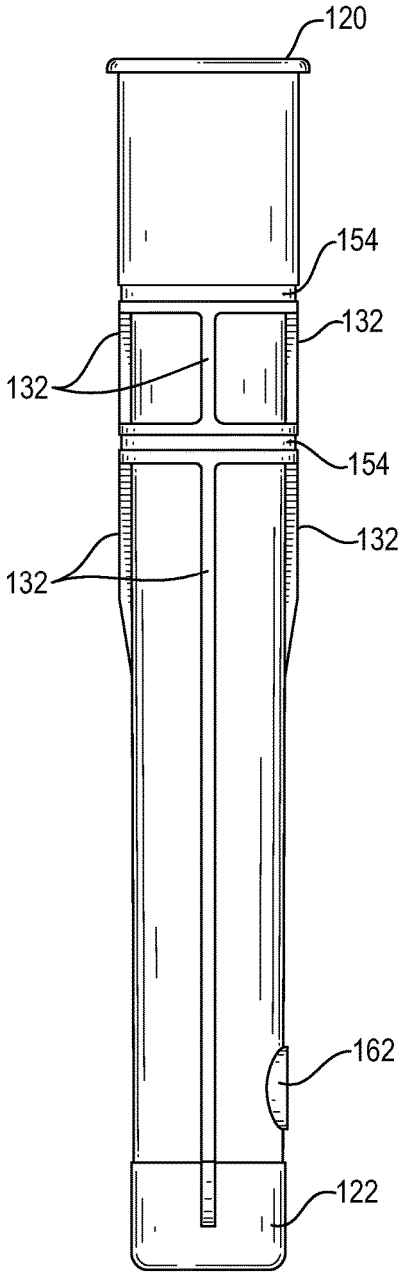
FIG. 5C is a side view of the upper end of the dip tube of FIG. 5B.

The upper end 110 may further include a spacer 130 for guiding and locating the upper end 110 during insertion into the nipple 12. In the embodiment of FIGS. 5A-5C, the spacer 130 is a plurality of ribs 132 extending axially along and protruding from the outer wall 116 of the upper end 110. Each rib 132 may extend axially at any given length along the outer wall 116 of the upper end 110. In the embodiment of FIGS. 5A-5C, a pair of opposing ribs 132 extends up to and into part of the reinforced connecting portion 122 while another pair of opposing ribs 132 extends partially along the outer wall 116 of the upper end 110.

Figure 7A:
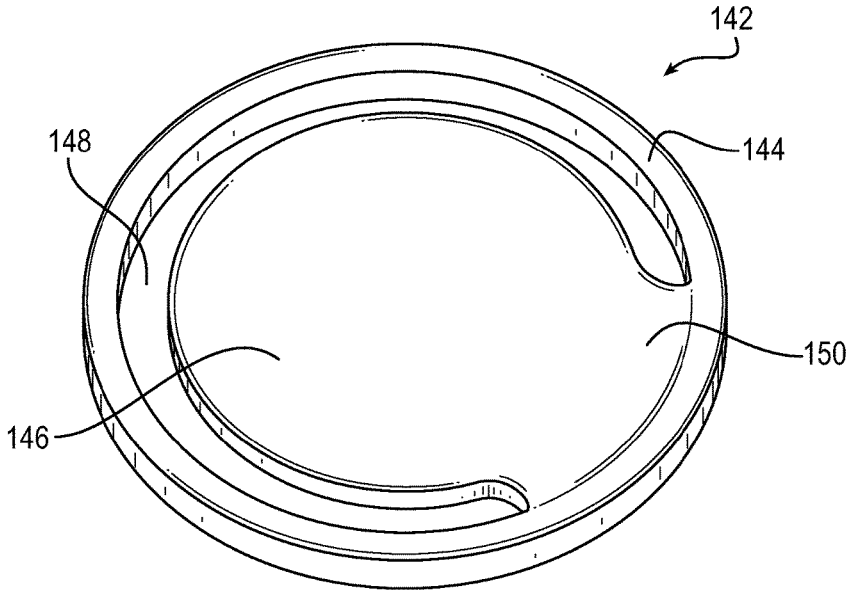
FIG. 7A is a perspective view of a heat flapper according to an embodiment of the present invention.
Figure 7B:
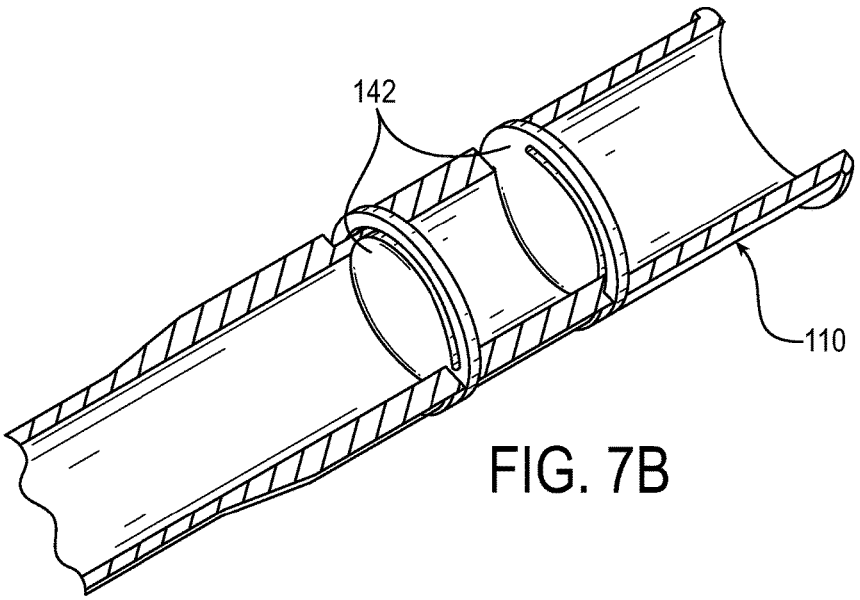
FIG. 7B is a partial cross sectional view of the upper end of the dip tube of FIG. 5A.

In the embodiment of FIGS. 5A-5C, the upper end 110 includes a heat trap assembly 140 for reducing heat loss by thermal convection flow of heated water from the water heater through its cold water inlet. The heat trap assembly 140 includes heat traps 142 which attach to the upper end 110. As shown in FIG. 7A, each heat trap 142 includes an outer ring portion 144, an inner circular portion 146, a partial circular slot 148 and a connecting portion 150. The connecting portion 150 connects the outer ring portion 144 to the inner portion 146. The inner portion 146 is substantially circular and has a diameter that is substantially the same as the inside diameter $ID_{110}$ of the upper end 110. Annular grooves 154 are formed in the outer wall 116 of the upper end 110 to accommodate the outer ring portion 144 of the heat traps 142. Circumferential slots 146 are formed in the annular grooves 144 to allow for insertion of the inner portion 146 of the heat traps 142. The circumferential slots may be located on opposite sides of the upper end 110. The inner portion 146 may be substantially circular or may be any other shape that substantially covers the inside diameter $ID_{110}$ the upper end 110. The heat traps 142 deflect to allow water to flow through the upper end 110 of the dip tube into the tubular body 170 and the water heater but substantially prevent outward convective water flow through the upper end 110.

The heat traps 142 may be made out of elastomeric material, such as rubber, that allow the outer ring portion 144 of the heat traps 142 to be stretched over the outer wall 116 of the upper end 110 and released back into the annular grooves 154. The inner portion 144 is inserted through the circumferential slot 146 of the annular groove 154 and into the inside diameter $ID_{110}$ of the upper end 110.

In the embodiment of FIG. 5A, the upper end 110 includes an anti-siphon hole 160 located above the reinforced connecting portion 122. The anti-siphon hole 160 prevents the water heater from being subject to a back-siphon vacuum of cold water from the bottom of the water heater. The anti-siphon hole 160 will only allow the water to back-siphon until the vacuum reaches the anti-siphon hole 160. Once the vacuum reaches the anti-siphon hole 160, the anti-siphon hole 160 will draw air through it and the water in the water heater will not drain down. As shown in FIG. 5C, an adjustable date code feature 162 is located on the outer wall 116 of the upper end 110. The adjustable date code feature 162 is a circular protrusion extending outwardly from the outer wall 116. The upper end 110 may also have the required UL/CSA markings for compliance with these standards.

The upper end 110 may be overmolded onto the tubular body 170 or mechanically attached. The upper end 110 may be molded using polyethylene and then crosslinked to create crosslinked polyethylene or PEX. The upper end 110 may be molded from any other material suitable for the environment inside a water heater.

The tubular body 170 may be extruded using known methods. The tubular body 170 includes an outer wall 172, an inner wall 174, a top end 176 and a bottom end 178. The tubular body has top opening 182 at the top end 176 and a bottom opening 184 at the bottom end 178. The tubular body is generally cylindrical but may be any other shape that will allow it to fit and be inserted through nipple 12. The tubular body includes an outside diameter $OD_{170}$ and an inside diameter $ID_{170}$ as seen in FIG. 8. The tubular body 170 has a thickness $T_{170}$ measured between the inner wall 174 and the outer wall 172. As seen in FIG. 2, a portion of the tubular body 170 is located within the reinforced connecting portion 122 of the upper end 110 with the remainder of the tubular body 170 extending away from the upper end 110. When installed in the water heater, the tubular body 170 is located below the coupling 20 of the water heater.

With reference to FIGS. 3 and 6A-6C, a lower end or dispersion tip 200 is connected to the bottom of the tubular body 170. The lower end 200 includes top end 202, a bottom end 204, an outer wall 206 and an inner wall 208. The lower end 200 includes an inner diameter $ID_{200}$ and an outer diameter $OD_{200}$ as seen in FIG. 8. The lower end 110 has a thickness $T_{200}$ measured between the inner wall 208 and the outer wall 206. The lower end 200 includes an top opening 212 at the top end 202. The lower end 200 is generally cylindrical but may be any shape that allows it to fit within the nipple 12 and into the water heater. As discussed below, the lower end 200 may include flattened portions on the outer wall 206. The lower end 200 includes a plurality of openings 220 to slow and disperse the flow of cold water coming from the tubular body 170 which reduces cold water mixing with the warmer water above and thus increases the amount of continuous hot water coming from the water heater during use.

The bottom end 204 includes a bottom wall 210 and is free from an opening or openings. The bottom wall 210 slows down the water coming from the tubular body 170 and allows the water to disperse more evenly through the plurality of openings 220. It has been found that the more openings included in the lower end, the greater the reduction of cold water mixing with the warmer water above and which increases the amount of continuous hot water coming from the water heater during use. Of course the lower end 200 must be structurally sufficient to withstand the incoming flow of cold water over time. Therefore, the plurality of openings are maximized but enough material remains between the plurality of openings for the lower end 200 to be structurally sufficient. In other words, the material is minimized between the plurality of openings for the lower end to be structurally sufficient during use within the water heater.

Figure 6A:
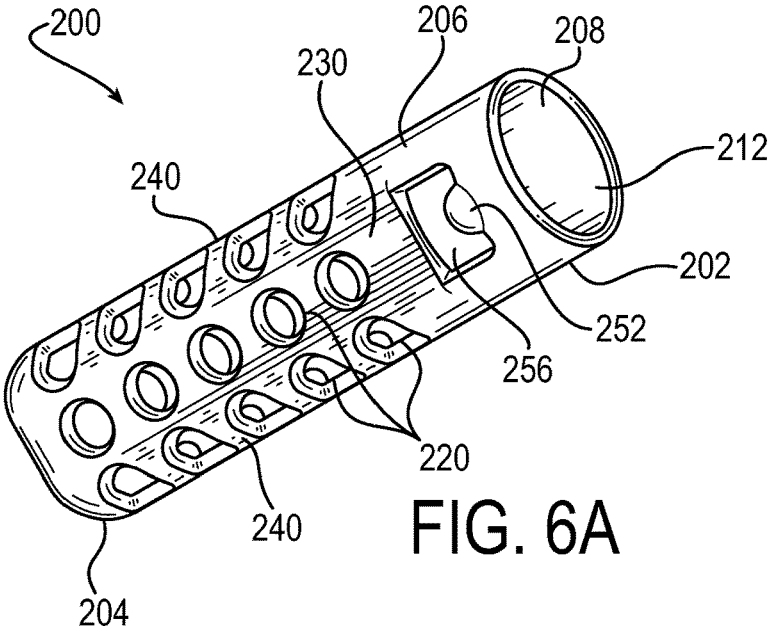
FIG. 6A is a perspective view of a lower end of the dip tube according to an embodiment of the present invention.
Figure 6B:
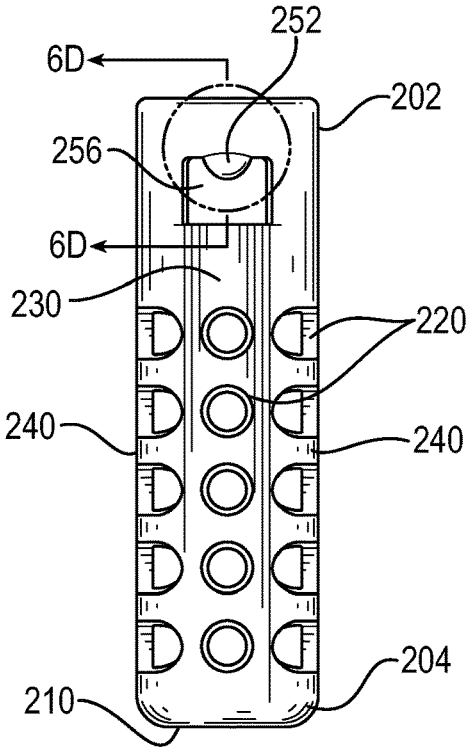
FIG. 6B is a front view of the lower end of the dip tube of FIG. 6A.
Figure 6C:
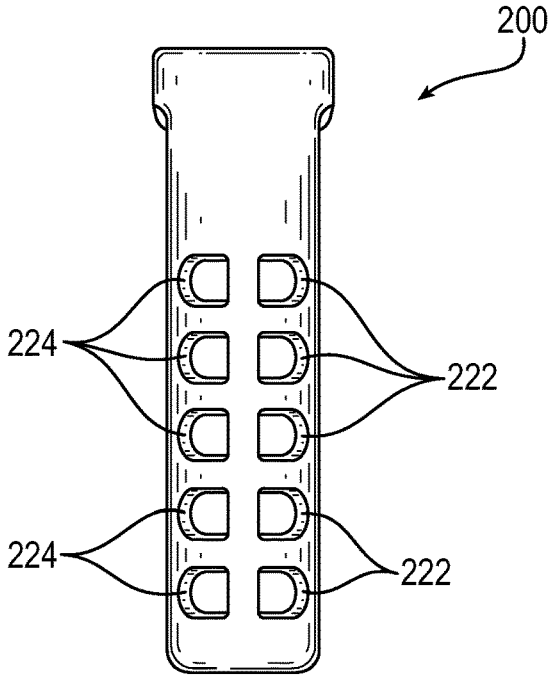
FIG. 6C is side view of the lower end of the dip tube of FIG. 6A.

In order to further strengthen the lower end 200, flattened portions 230 are included on opposing sides of the lower end 200. Cylindrical portions 240 are located on either side of the flattened portions 230. The flattened portions 230 extend from the bottom end 204 up until the lower end 178 of the tubular body 170. As shown in FIGS. 6A and 6B, the openings 220 in the flattened portions 230 are substantially circular. The openings 220 on the cylindrical portions 240 are substantially "D-shaped." In order to maximize the openings on the cylindrical portions 240 and still retain enough material between the openings to be structurally sufficient, a first set of D-shaped openings 222 are positioned adjacent a second set of D-shaped openings 224 where the straight portions 226 of the D-shaped openings are proximal one another and the curved portions 228 of the D-shaped openings are distal each other as seen in FIG. 6C.

The opening 212 at the top end 202 has the inside diameter $ID_{200}$ that is substantially the same as the outside diameter $OD_{170}$ of the tubular body 170 so that a portion of the tubular body 170 is located securely within the top end 202 of the lower end 200. The lower end 200 may be overmolded onto the tubular body 170 or mechanically attached. The lower end 200 may be molded using polyethylene and then crosslinked to create crosslinked polyethylene or PEX. The lower end 200 may be molded from any other material suitable for the environment inside a water heater.

Figure 6D:
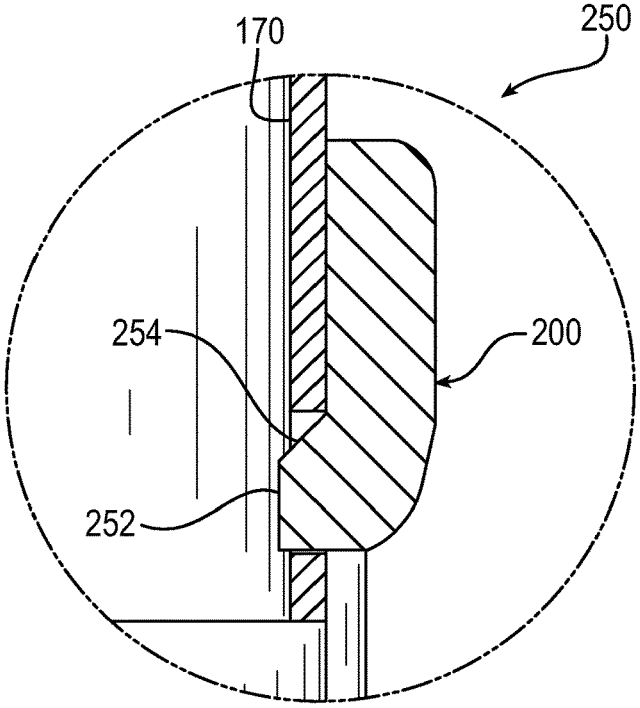
FIG. 6D is an enlarged cross sectional view of the dip tube of FIG. 6A.

FIGS. 4, 6A, 6B and 6D display a mechanical attachment of the lower end 200 to the tubular body 170. A locking system 250, such as a detent mechanism, is located at the top end 202 of the lower end 200. The locking system 250 includes opposing protrusions 252 extending inwardly from the inner wall 208. The protrusions 252 include chamfers 254 as seen in FIG. 6D. Opposing recesses 256 are located below the opposing protrusions 252 and allow the protrusions 252 to flex outwardly upon insertion of the tubular body 170. The tubular body 170 includes opposing openings 180 at the bottom end 178 to accommodate the protrusions 252 and secure the lower end 200 to the tubular body 170. As a portion of the tubular body 170 is inserted into the lower end 200, the top end 176 of the tubular body 170 contacts the chamfers and forces the protrusions 252 outwardly. When the protrusions 252 reach the openings 180 during insertion of the tubular body 170, the protrusions 252 spring back or snap back into the openings 180 to secure the lower end 200 to the tubular body.

Figure 13:
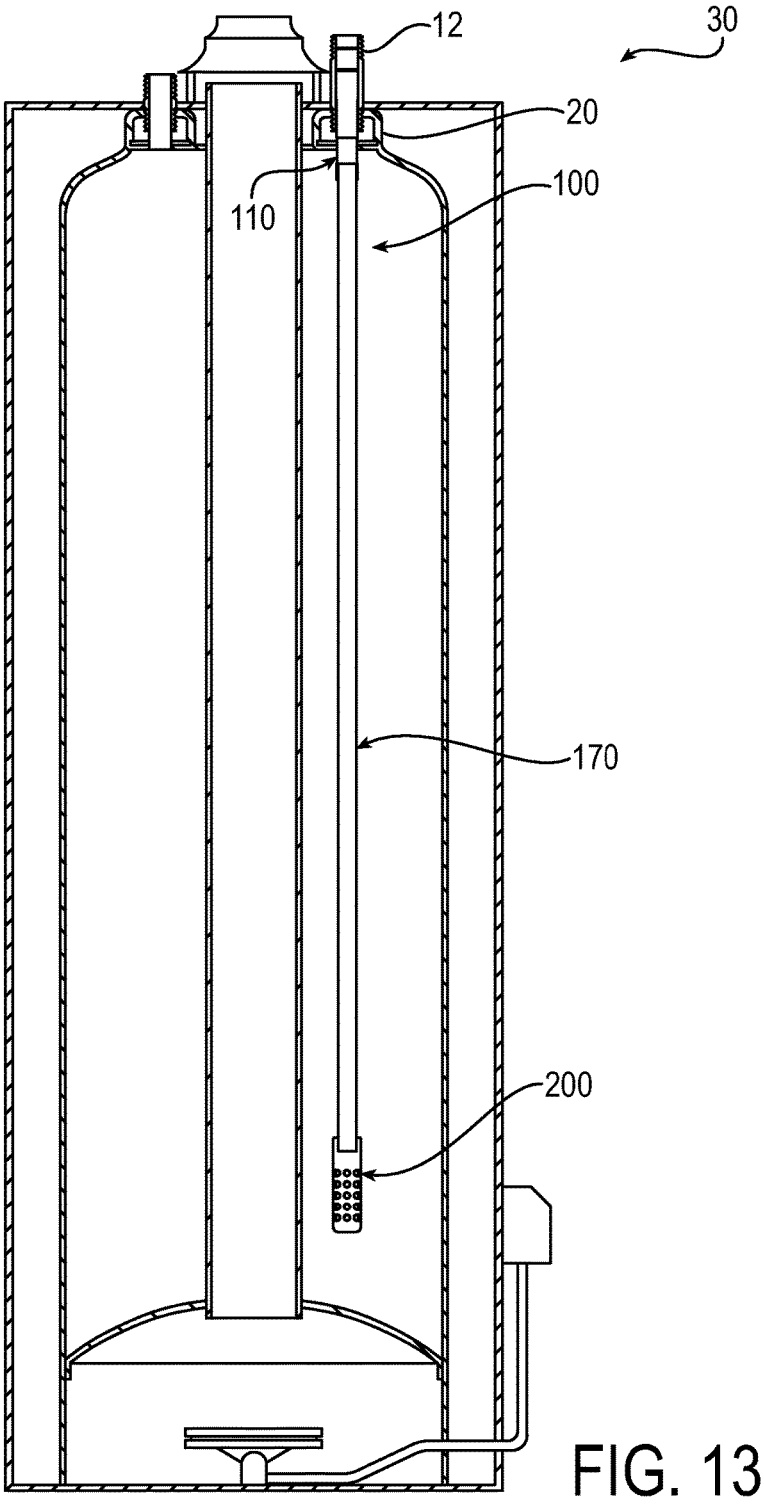
FIG. 13 is a partial cross section view of a water heater including a dip tube according to an embodiment of the present invention.

FIG. 13 shows a water heater 30 with the dip tube 100 installed therein as previously described.

Figure 9:
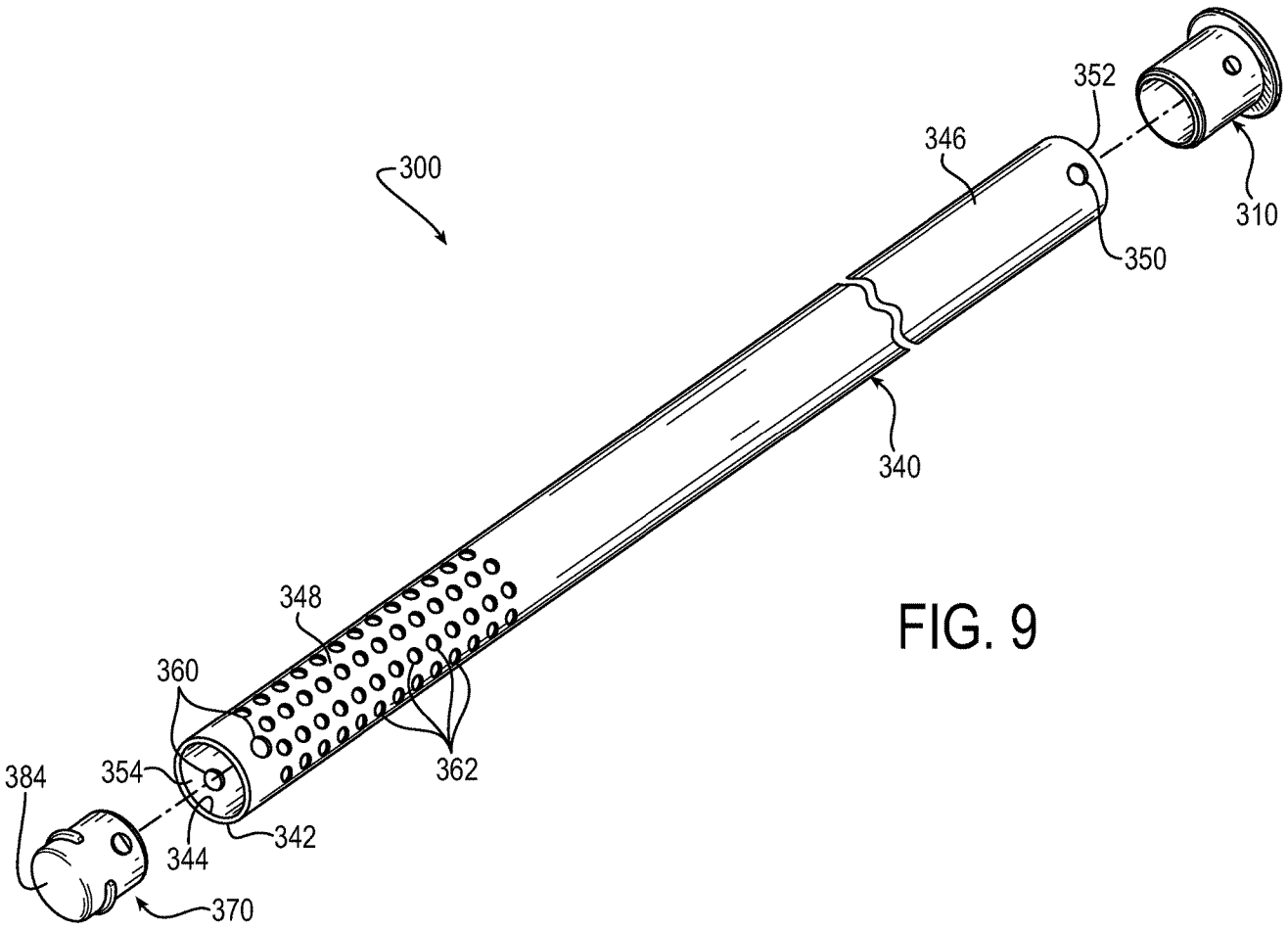
FIG. 9 is an exploded perspective view of a dip tube according to alternative embodiment of the present invention.
Figure 12:
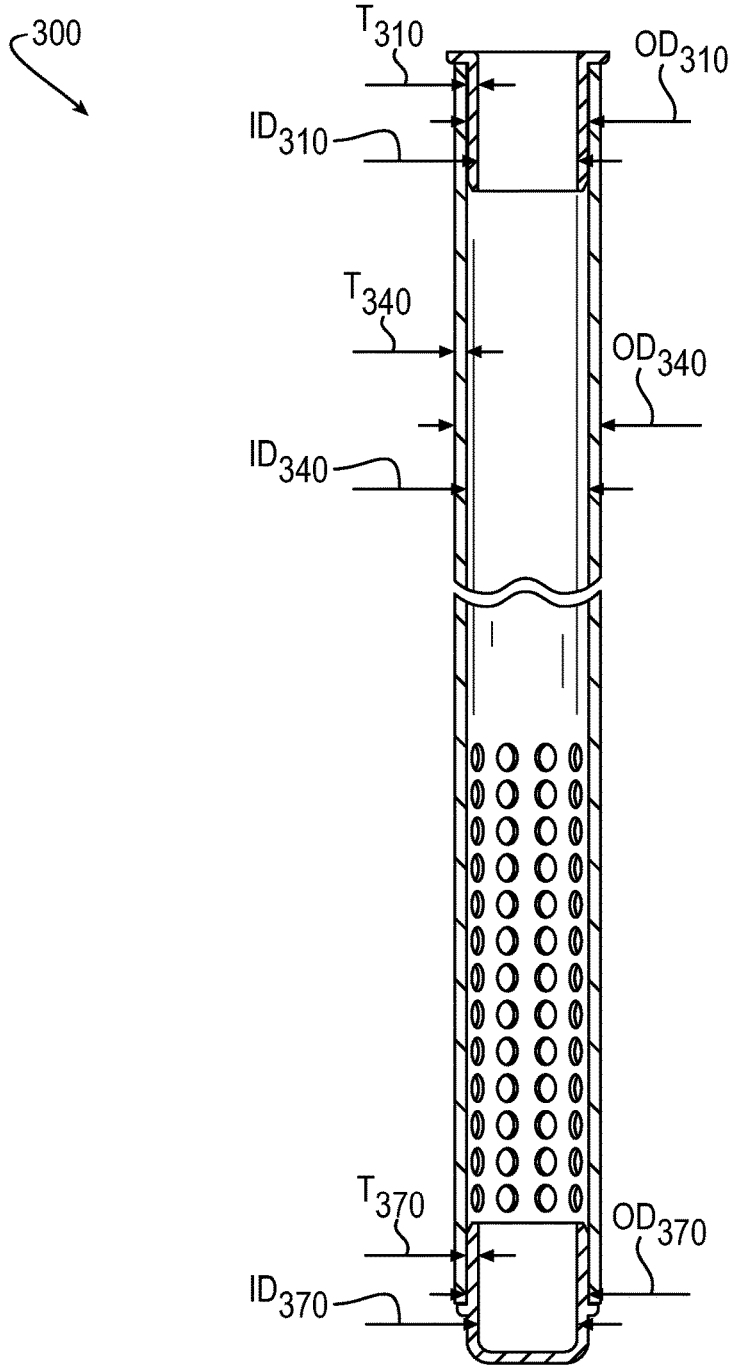
FIG. 12 is is a cross sectional view of the dip tube of FIG. 9.

FIG. 9 displays an alternative embodiment of a dip tube 300 according to the present invention. An exploded view of the dip tube 300 as shown includes an upper end 310, a tubular body 340 and a lower end 370. The tubular body 340 may be extruded using known methods. The tubular body 340 includes an outer wall 342, an inner wall 344, a top end 346 and a bottom end 348. The tubular body includes an outside diameter $OD_{340}$ and an inside diameter $ID_{340}$ as seen in FIG. 12 The tubular body 340 has a thickness $T_{340}$ measured between the inner wall 344 and the outer wall 346. The tubular body has top opening 352 at the top end 346 and a bottom opening 354 at the bottom end 348. The tubular body 340 is generally cylindrical but may be any other shape that will allow it to fit and be inserted through nipple 12. The tubular body 340 includes openings 362 that may be drilled or punched in the side of the tubular body 340 near its bottom end 348 to disperse the cold water at the bottom of the water heater.

Figure 11A:
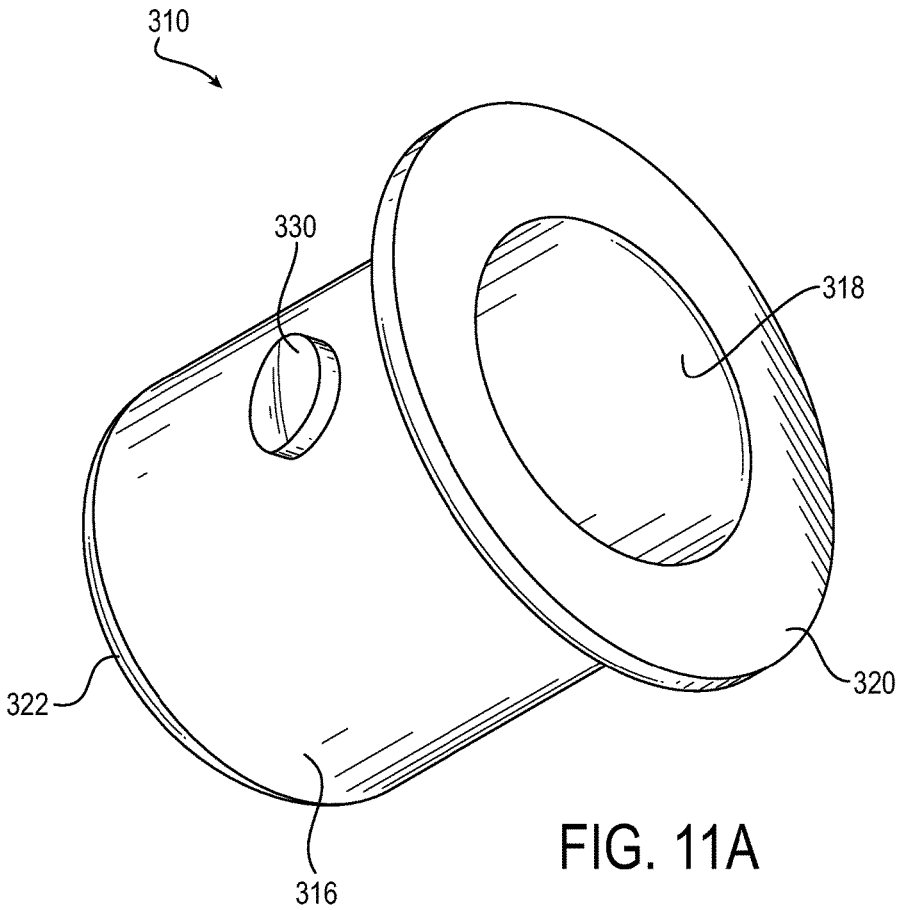
FIG. 11A is a perspective view of an upper end of the dip tube as shown in FIG. 8.
Figure 11B:
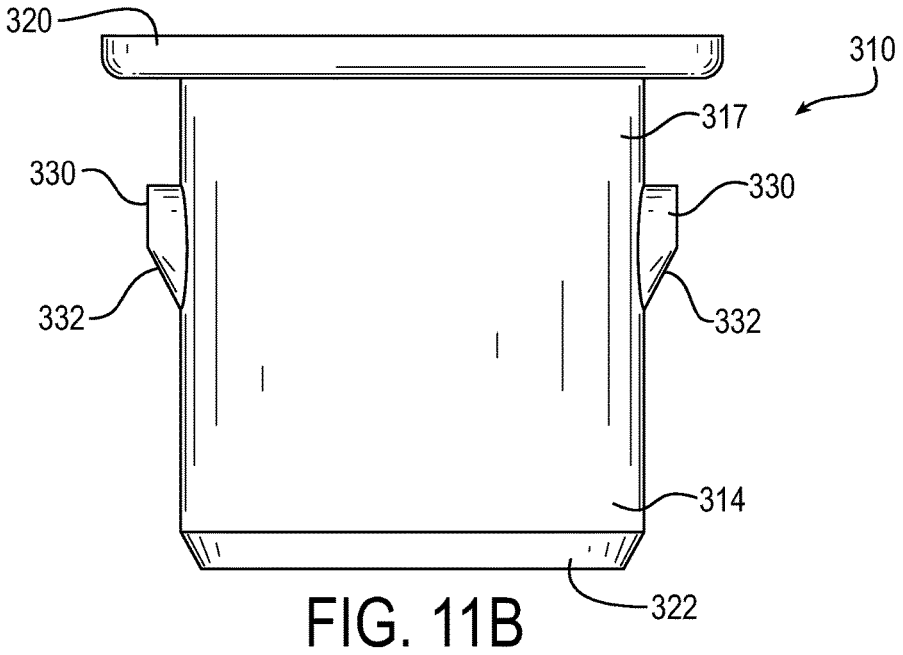
FIG. 11B is a front view of the upper end of the dip tube of FIG. 10A.
Figure 11C:
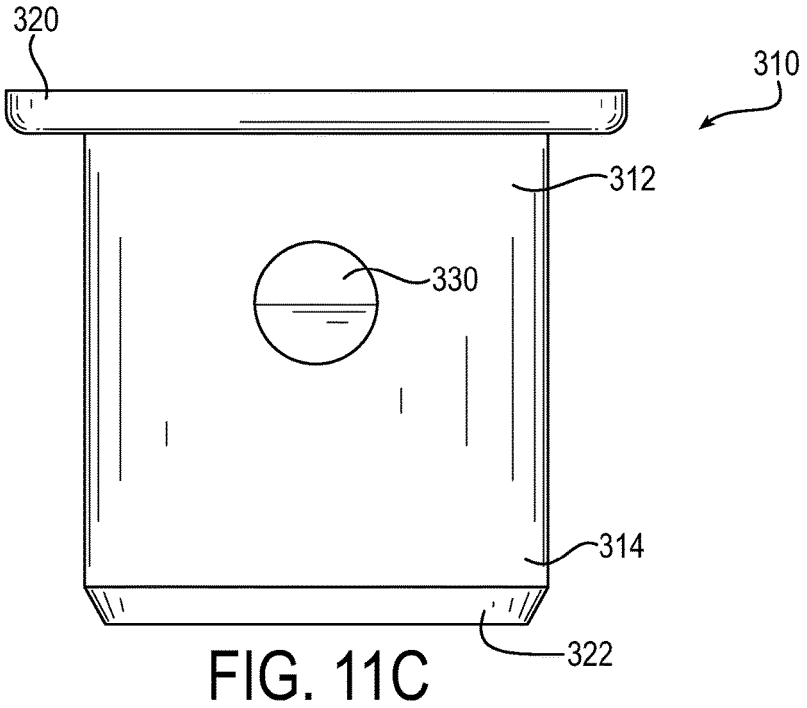
FIG. 11C is a side view of the upper end of the dip tube of FIG. 10A.

With reference to FIGS. 11A-11C, the upper end 310 has a top portion 312, a bottom portion 314, an outer wall 316 and an inner wall 318. The upper end 110 includes an inner diameter $ID_{310}$ and an outer diameter $OD_{310}$ as seen in FIG. 12. The upper end 310 has a thickness $T_{310}$ measured between the inner wall 318 and the outer wall 316. The upper end 310 includes a flange 320 located near the top portion 312. The flange 320 extends outwardly from the outer wall 316 and around the entire circumference of the upper end 310. In an alternative embodiment, the flange 320 may extend only partially around the circumference of the upper end 310. In other words, the flange 320 may either be a solid radial flange or one with gaps to allow. The flange with gaps may allow for more efficient molding. The flange 320 retains the dip tube 300 in the nipple 12 and prevents the dip tube 300 from falling into the nipple 12 when installed in the water heater. The flange 320 sits upon the top of the nipple 12 similar to the embodiment as seen in FIG. 2. The flange 320 may abut the top end 346 when the upper end 310 is inserted into the tubular body 340.

As shown in the embodiment of FIGS. 9 and 11A-11C, the upper end 310 is mechanically attached to the tubular body 340. The outer wall 316 of the upper end 310 is inserted into the inside diameter $ID_{340}$ of the tubular body 340. The upper end 310 includes a lower chamfer 322 at the bottom portion 314 to ease insertion of the upper end 310 into the tubular body 340. The upper end 310 includes opposing protruding pins 330 on the outer wall 316. The protruding pins 330 each include a chamfer 332 as seen in FIG. 11B to engage and expand the inner wall 344 of the tubular body 340 when the upper end 310 is inserted into the bottom opening 354 of the tubular body 340. The tubular body 340 includes two opposing openings 350 to accommodate the protruding pins 330 of the upper end 310. The openings 350 may be formed by punching, drilling or any other known method. When the protruding pins 330 reach the respective openings 350 during insertion, the upper end is snapped and secured into the tubular body 340. Any type of known mechanical connection can be used to attach the upper end 310 to the tubular body 340, including the mechanical connection shown and described in FIGS. 6A-6D with respect to the lower end 200.

The upper end 310 may be injection molded or formed by other known molding methods. The upper end 310 may also be overmolded onto the tubular body 340 without the need for a mechanical connection. The upper end 310 may be molded using polyethylene and then crosslinked to create crosslinked polyethylene or PEX. The upper end 310 may be molded from any other material suitable for the environment inside a water heater.

The upper end 310 including the flange 320 replaces a high temperature flaring operation whereby the end of the tubular body 340 has a flange formed by melting plastic. This flaring operation requires an expensive piece of equipment and runs with high scrap rates. The upper end 310 can be installed very quickly by an operator or automation either in line with the extrusion process of the tubular body 340 or as a secondary operation.

Figure 10A:
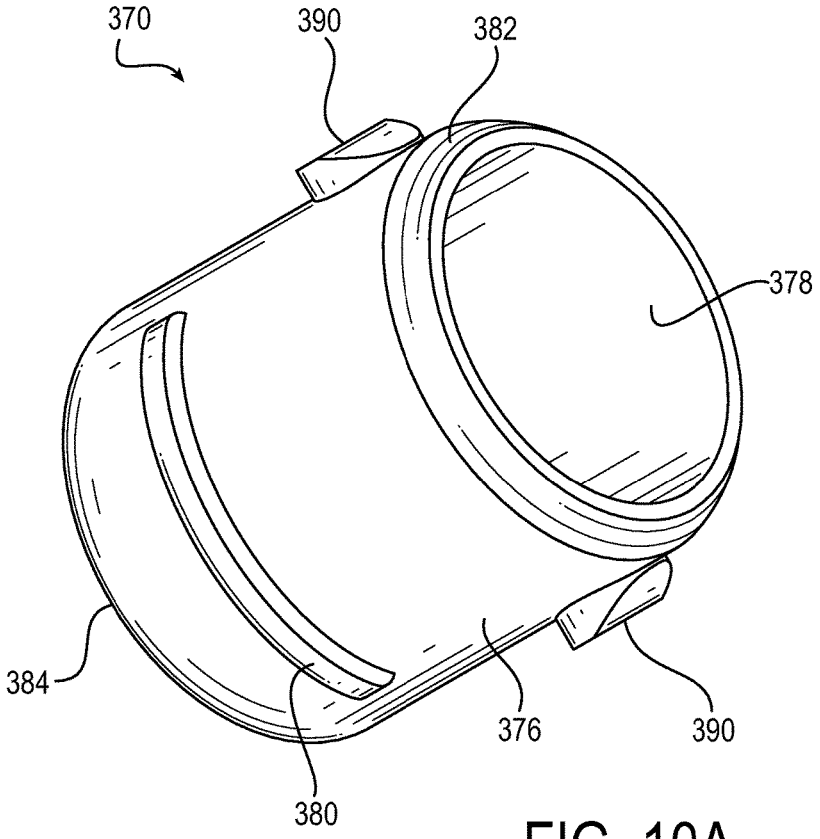
FIG. 10A is a perspective view of a lower end of the dip tube as shown in FIG. 8.
Figure 10B:
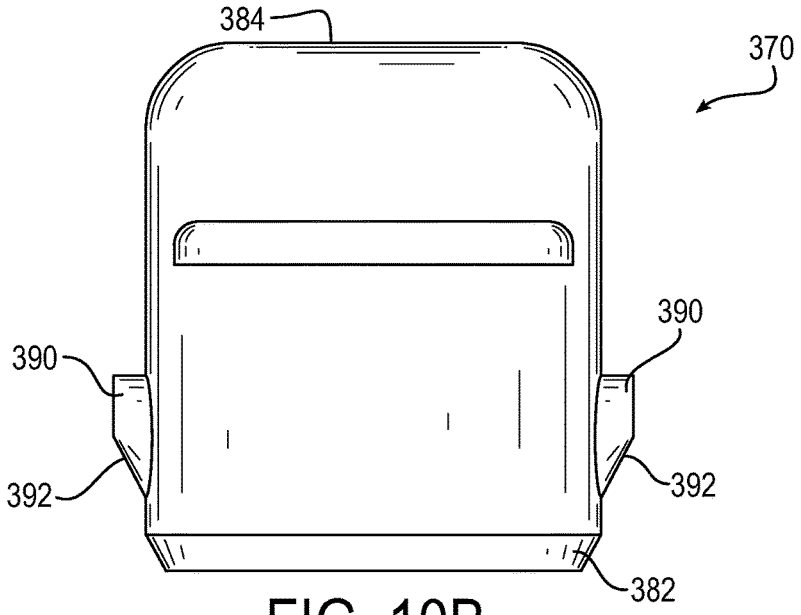
FIG. 10B is a front view of the lower end of the dip tube of FIG. 9A.
Figure 10C:
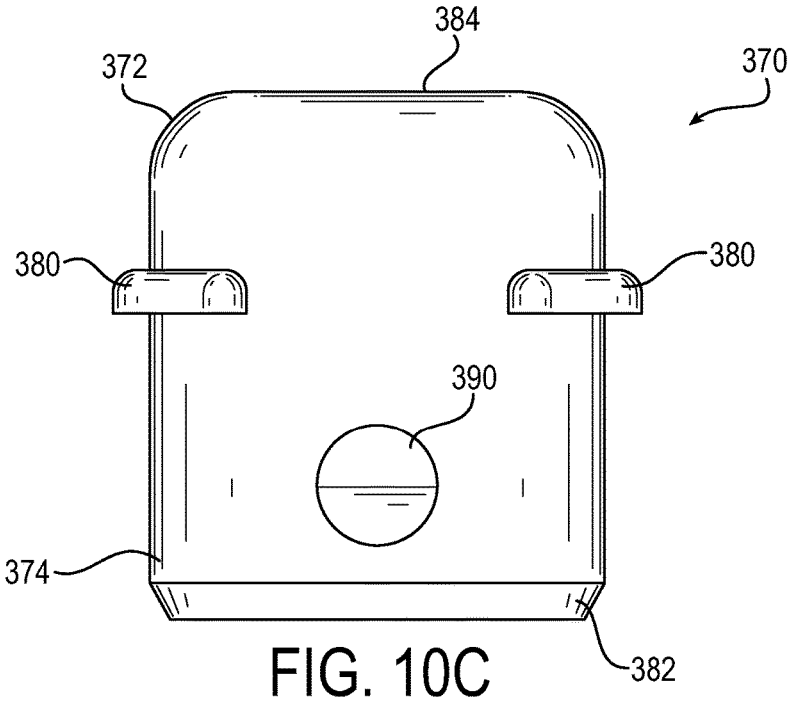
FIG. 10C is a side view of the lower end of the dip tube of FIG. 9A.

With reference to FIGS. 10A-10C, the lower end 370 has a top portion 372, a bottom portion 374, an outer wall 376 and an inner wall 378. The lower end 370 includes an inner diameter $ID_{370}$ and an outer diameter $OD_{370}$ as seen in FIG. 12. The lower end 370 has a thickness $T_{370}$ measured between the inner wall 378 and the outer wall 376. The lower end 370 also includes a stop flange 380 to prevent relative movement between the lower end 370 and the tubular body 340. The stop flange 380 extends only partially around the circumference of the lower end 370. Alternatively, the stop flange 380 may extend fully around the circumference of the lower end 370. In other words, the stop flange 380 may either be a solid radial flange or one with gaps. The stop flange with gaps may allow for more efficient molding. The lower end 370 also includes a bottom wall 384 which prevents water from escaping the opening 352 in the bottom end 346 when the lower end 370 is inserted into the tubular body 340.

As shown in the embodiment of FIGS. 9 and 10A-10C, the lower end 310 is mechanically attached to the tubular body 340. The outer wall 376 of the lower end 370 is inserted into the inside diameter $ID_{340}$ of the tubular body 340. The lower end 370 includes a lower chamfer 382 at the bottom portion 374 to ease insertion of the lower end 370 into the tubular body 340. The lower end 370 includes opposing protruding pins 390 on the outer wall 376. The protruding pins 390 each include a chamfer 392 as seen in FIG. 10B to engage and expand the inner wall 344 of the tubular body 340 when the lower end 370 is inserted into the tubular body 340. The tubular body 340 includes two opposing openings 360 to accommodate the protruding pins 370 of the lower end 370. The openings 360 may be formed by punching, drilling or any other known method. When the protruding pins 390 reach the respective openings 360 during insertion, the lower end 370 is snapped and secured into the tubular body 340. Any type of known mechanical connection can be used to attach the lower end 370 to the tubular body 340, including the mechanical connection shown and described in FIGS. 6A-6D with respect to the lower end 200.

The lower end 370 may be injection molded or formed by other known molding methods. The upper end 370 may also be overmolded onto the tubular body 340 without the need for a mechanical connection. The upper end 370 may be molded using polyethylene and then crosslinked to create crosslinked polyethylene or PEX. The upper end 370 may be molded from any other material suitable for the environment inside a water heater.

The lower end 370 including the bottom wall 384 replaces a heat sealing operation which has traditionally been used to close the bottom end of dip tubes. This heat sealing process produces inconsistent results and requires an expensive piece of equipment. By contrast, the lower end 370 provides a consistent seal to the bottom opening 354 of the tubular body 340 that can be easily manufactured. The lower end 370 can be installed very quickly by an operator or automation either in line with the extrusion process of the tubular body 340 or as a secondary operation.

In one application, the upper ends 110, 310, the tubular body 170, 340, and the lower ends 200, 370 are made from high density polyethylene that is crosslinked (PEX). PEX contains crosslinked bonds in the polymer structure changing the thermoplastic into a thermoset. Crosslinking may be accomplished during or after the molding of the part. The required degree of crosslinking for crosslinked polyethylene tubing, according to ASTM Standard F 876-93 is between 65-89%. There are three classifications of PEX, referred to as PEX-A, PEX-B, and PEX-C. PEX-A is made by the peroxide (Engel) method. In this method, peroxides blended with the polymer performs crosslinking above the crystal melting temperature. The polymer is typically kept at an elevated temperature and pressure for long periods of time during the extrusion process to form PEX-A. PEX-B is formed by the silane method, also referred to as the "moisture cure" method. In this method, silane compounds blended with the polymer induces crosslinking during molding and during secondary post-extrusion processes, producing cross-links between a crosslinking agent. The process is accelerated with heat and moisture. The crosslinked bonds are formed through silanol condensation between two grafted vinyltrimethoxysilane units. PEX-C is produced by application of radiation, such as by an electron beam using high energy electrons to split the carbon-hydrogen bonds and facilitate crosslinking.

The upper ends 110, 310, the tubular body 170, 340, and the lower ends 200, 370 may be polyethylene or crosslinked polyethylene (PEX) as discussed above, but may also be made from various other polymers as desired for the application. In the practice of this invention, illustrative and non-limiting examples of the polymers that may be used in various combinations to form the upper end 110, 310 the tubular body 170, 340 and the lower end 200,370 include: polyacetals, nylons or polyamides, including various types of nylon-6, nylon-6/6, nylon-6/9, nylon-6/10, nylon-6/12, nylon-11, nylon-12, acrylonitrile butadiene styrene terpolymers, polystyrenes, polycarbonates, polyvinyl chlorides and chlorinated polyvinyl chlorides, polyethylene terephthalate polyester, polyethylene homopolymers and copolymers, including all molecular weight and density ranges and degrees of crosslinking, polypropylene homopolymers and copolymers, polybutene resins, poly(meth)acrylics, polyalkylene terephthalates, polyetherimides, polyimides, polyamide-imides, polyacrylates of aromatic polyesters, polyarylether ketones, polyacrylonitrile resins, polyphenylene oxides including polystyrene miscible blends, polyphenylene sulfides, styrene-acrylonitrile copolymers, styrene-butadiene copolymers, styrene maleic anhydride copolymers, polyarylsulfones, polyethersulfones, polysulfones, ethylene acid copolymers, ethylene-vinyl acetate copolymers, ethylene-vinyl alcohol copolymers, thermoplastic elastomers covering a hardness range of from 30 Shore A to 75 Shore D, including styrenic block copolymers, polyolefin blends (TPO), elastomeric alloys, thermoplastic polyurethanes (TPU), thermoplastic copolyesters, and thermoplastic polyamides, polyvinylidene chlorides, allyl thermosets, bismaleimides, epoxy resins, phenolic resins, unsaturated thermoset polyesters, thermoset polyimides, thermoset polyurethanes, and urea and melamine formaldehyde resins. Other polymeric materials may be selected as suitable for a desired application.

In one embodiment, the polymers for the upper end 110, 310, the tubular body 170, 340, and the lower end 200, 370 may high density polyethylene, which is subsequently crosslinked, preferably by the application of an electron beam, although other modes of crosslinking are envisioned to be within the scope of this invention. In another embodiment, the polymers for the upper end 110, 310 the tubular body 170, 340 and the lower end 200, 370 may be glass-filled high density polyethylene, which is subsequently crosslinked by application of an electron beam.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected by the appended claims and the equivalents thereof.

What is claimed is:

1. A dip tube for use with a water heater having a pipe nipple, the pipe nipple having a top, the dip tube comprising:

an upper end and a tubular body, the upper end being located above the tubular body;

the upper end having an outer wall, a top and a bottom, the upper end comprising:

a flange extending outwardly from the outer wall at the top of the upper end, the flange configured to retain the dip tube at the top of the nipple in an installed position;

a heat trap assembly, the heat trap assembly being integral with the upper end, where the heat trap assembly comprises at least one heat trap including an outer ring portion, the heat trap comprising elastomeric material; and an overlapping connection at the bottom of the upper end and a top of the tubular body for connecting the bottom of the upper end to the top of the tubular body, wherein either the bottom of the upper end overlaps the top of the tubular body or the top of the tubular body overlaps the bottom of the upper end, and wherein the upper end and the tubular body are mechanically attached at the overlapping connection.

2. The dip tube of claim 1, where the overlapping connection maintains the position of the tubular body in the absence of a gasket and a retaining cup.

3. The dip tube of claim 1 further comprising a spacer for guiding and locating the upper end during insertion into the pipe nipple.

4. The dip tube of claim 3, where the spacer is a plurality of ribs extending axially along the outer wall of the upper end.

5. The dip tube of claim 1, where the heat trap assembly further comprises:

at least one annular groove located on the outer wall of the upper end and having a circumferential slot; and the at least one heat trap, further comprising an inner portion, and a connecting portion connecting the outer ring portion to the inner portion;

where the outer ring portion is located within the at least one annular groove and the inner portion extends through the circumferential slot and is located within the tubular body.

6. The dip tube of claim 1, further including a lower end connected to the tubular body, the lower end comprising:

a top end, a bottom end, an outer wall, an inner wall and a bottom wall; and a plurality of openings to slow and disperse the flow of water from the tubular body into the water heater;

where a portion of the tubular body is located within the top end of the lower end.

7. The dip tube of claim 6, where the lower end is overmolded onto the tubular body.

8. The dip tube of claim 6, where the lower end is mechanically attached to the tubular body.

9. The dip tube of claim 6, where the lower end is generally cylindrical.

10. The dip tube of claim 6, where the outer wall includes opposing flattened portions on the lower end.

11. The dip tube of claim 6, where the plurality of openings are maximized to slow and disperse the flow of water from the tubular body into the water heater and the material is minimized between the plurality of openings for the lower end to be structurally sufficient during use within the water heater.

12. The dip tube of claim 10, where cylindrical portions are located on either side of the flattened portions on the lower end;

where the plurality of openings include circular openings on the flattened portions and D-shaped openings on the cylindrical portions.

13. The dip tube of claim 12, where the D-shaped openings include a first set of openings positioned adjacent a second set of openings, where the straight portions of the D-shaped openings are proximal one another and the curved portions of the D-shaped openings are distal each other.

14. The combination of a dip tube and a pipe nipple for use with a water heater, the combination comprising:

the pipe nipple having a top, a bottom, an upper threaded end at the top and a lower threaded end at the bottom; and the dip tube comprising:

an upper end and a tubular body, the upper end being located above the tubular body;

the upper end having an outer wall, a top and a bottom, the upper end comprising:

a flange extending outwardly from the outer wall at the top of the upper end for retaining the dip tube at the nipple;

a heat trap assembly, the heat trap assembly being integral with the upper end, where the heat trap assembly comprises at least one heat trap including an outer ring portion, the heat trap comprising elastomeric material; and an overlapping connection at the bottom of the upper end and a top of the tubular body for connecting the bottom of the upper end to the top of the tubular body, wherein either the bottom of the upper end overlaps the top of the tubular body or the top of the tubular body overlaps the bottom of the upper end, and wherein the upper end and the tubular body are mechanically attached at the overlapping connection;

where the flange of the dip tube is positioned on the upper threaded end at the top of the pipe nipple.

15. The combination of claim 14, further including a coupling for attaching the pipe nipple to the water heater, where the combination is free of a gasket and a retaining cup;

where the pipe nipple is free of an integrally attached dielectric liner and a separate heat trap assembly.

* * * * *